United States Patent [19]

Clarke et al.

[11] Patent Number: 4,844,845

[45] Date of Patent: Jul. 4, 1989

[54] DRY MIXTURE FOR PRODUCTION OF PRE-FORMED PROPELLANT CHARGE

[75] Inventors: Stephen E. Clarke, Orange; James D. Hendry, Huntington Beach, both of Calif.

[73] Assignee: Ford Aerospace Corporation, Newport Beach, Calif.

[21] Appl. No.: 138,616

[22] Filed: Dec. 28, 1987

[51] Int. Cl.[4] ..... C06B 45/10; C06B 21/00; C06B 25/18

[52] U.S. Cl. ..... 264/3.1; 149/19.8; 149/19.92; 149/21; 149/96; 149/100; 149/109.6

[58] Field of Search ..... 149/19.92, 21, 96, 100, 149/109.6, 19.8; 264/3.1

[56] References Cited

U.S. PATENT DOCUMENTS

| | | | |
|---|---|---|---|
| 2,646,596 | 7/1953 | Thomas et al. | 264/3.1 |
| 3,373,062 | 3/1968 | Morris | 149/6 |
| 3,379,796 | 4/1968 | Hewson et al. | 264/3.1 |
| 3,395,055 | 7/1968 | Sparks et al. | 149/21 |
| 3,441,455 | 4/1969 | Woods et al. | 149/8 |
| 3,447,983 | 6/1969 | Camp et al. | 149/98 |
| 3,456,042 | 7/1969 | Winer | 264/3 |
| 3,728,172 | 4/1973 | Dillehay et al. | 149/21 |
| 4,051,207 | 9/1977 | Brachert et al. | 264/3.3 |
| 4,315,785 | 2/1982 | Brodman et al. | 149/19.8 |
| 4,410,378 | 10/1983 | Hattori et al. | 149/109.6 |
| 4,532,851 | 8/1985 | Reinelt et al. | 149/2 |
| 4,758,289 | 7/1988 | Sudweeks et al. | 149/109.6 |
| 4,764,316 | 8/1988 | Brown et al. | 264/3.1 |

*Primary Examiner*—Edward A. Miller

*Attorney, Agent, or Firm*—Peter D. McDermott; Roger L. May

[57] ABSTRACT

The invention is directed to a formable homogeneous propellant composition and to a process employing same for production of a self-supporting formed propellant charge. The propellant composition comprises a mixture of propellant grains and solvent-filled microcapsules in proportions suitable for consolidation under pressure to form the self-supporting formed propellant charge. The solvent-filled microcapsules comprise solvent suitable for partially solvating the propellant grains. The mixture of propellant grains and solvent-filled microcapsules are placed in a forming mold under sufficient pressure to rupture at least a substantial portion of the microcapsules. Pressure is maintained for a time sufficient to form the self-supporting formed propellant charge, after which the propellant charge can be removed from the forming mold and cured by exposure to drying heat.

19 Claims, No Drawings

DRY MIXTURE FOR PRODUCTION OF PRE-FORMED PROPELLANT CHARGE

BACKGROUND OF THE INVENTION

TECHNICAL FIELD

This invention relates generally to pre-formed propellants used, for example, in telescoped ammunition rounds and the like. More particularly, the invention relates to a formable propellant charge composition and to a dry press process for using same in the production of pre-formed propellant charges.

PRIOR ART

Combustible propellant charges have long been known for use in ammunition rounds, rocket propelled missiles, etc. Solid propellants generally are classified as being either homogeneous or composite. The present invention is directed to the former, which refers to those propellants, usually containing nitrocellulose, which are considered monopropellants, each molecule containing all the necessary fuel and oxygen for combustion. The composite-type propellant, in contrast, consists of a physical mixture of a fuel and an oxidizer. The homogeneous nitrocellulose propellants may be further subclassified as being either single or double base, depending on whether the composition contains nitrocellulose as the sole combustible or contains additional compounds, e.g. additional nitroxy compounds such as nitroglycerin, as a second combustible.

Various methods have long been known for production of homogeneous propellants, including the so-called "solvent" and "solventless" techniques. In the solvent process, solvents such as acetone or ether-based alcohol mixtures are used to dissolve and colloid nitrocellulose to form a viscous or doughy mass. The mass then is granulated, usually by extrusion. The volatile solvent may be recovered. According to the solventless process, nitrocellulose is slurried in a non-solvent to form a paste-like mixture which is dried and rolled on hot rolls. The resulting sheet is extruded or cut into the desired granulation. In U.S. Pat. No. 3,447,983 to Camp et al, a method is disclosed for strengthening the mechanical properties of homogeneous nitrocellulose base propellants which have been prepared by the solventless technique. In the Camp et al patent it is taught to expose a homogeneous nitrocellulose-containing propellant composition to the vapor phase of an organic solvent of the type ordinarily used in the "solvent" process.

Where higher combustion rates are desired, it is known to form the propellant, generally by extrusion, with perforations to add surface area. Typically, for example, small cylindrical shapes are extruded having an axial perforation therethrough. Other configurations are known, some having multiple perforations. Also, it is known in the art to provide homogeneous nitrocellulose propellants in a deterred configuration. This may comprise, for example, a coating on the surface of the propellant, which coating typically comprises a slurry dried on the surface of the propellant. Homogeneous nitrocellulose propellants typically comprise a small amount, e.g. 3%, of methylcentralite coating or the like. The greater the amount of slurry dried onto the surface of the propellant, the more the propellant is deterred. To facilitate handling, ignition and safety, most homogeneous propellants are coated also with graphite in a final process.

Homogeneous nitrocellulose propellants frequently are employed as a pre-formed propellant charge. That is, in certain applications, it is necessary or desirable to consolidate the homogeneous propellant, whether formed by the aforesaid solvent or solventless process, into a pre-formed, solid, self-supporting shape. In some cases this may be done directly in the ammunition casing in which the charge is to remain. In other cases the charge is pre-formed in a forming mold and subsequently transferred into the casing or other housing in which it is to be employed.

Presently, such pre-formed or consolidated propellant charges are fabricated according to various known methods. Typically, a consolidated propellant charge is fabricated by a so-called wet molding process by solvating loose propellant in a forming mold with a mixture of suitable solvent followed by consolidating the mixture into a hard pellet by application of pressure. Once consolidated, the pellets are removed from the forming mold, cured in a drying oven and then inserted into the ammunition cartridge or other intended housing. Several significant disadvantages inhere in such current methods. There is difficulty controlling the weight of the molded propellant charge due to variations in the relative proportions of solvent and solute. In addition, the solvating step of the wet molding process is time consuming and imprecise and cannot readily be fully automated, which would be highly desirable in the production of propellant charges.

It is an object of the present invention to provide a formable propellant charge composition which eliminates the separate solvating step, that is the wetting cycle, of the wet molding process for the fabrication of formed propellant charges. More precisely, it is an object of the invention to provide a formable propellant charge composition which is a dry mixture of ingredients. It is a further object of the invention to provide a dry process for the fabrication of formed propellant charges employing such dry mixture. These and additional objects of the invention will be understood in light of the following disclosure.

SUMMARY OF THE INVENTION

According to a first aspect of the present invention, a formable homogeneous propellant composition comprises a mixture of propellant grains and solvent-filled microcapsules in proportion suitable for consolidation under pressure to form a self-supporting formed propellant charge, the solvent-filled microcapsules comprising solvent suitable for solvating the propellant grains.

According to a method aspect of the invention, a dry process for production of a self-supporting formed propellant charge comprises:

providing in a forming mold, which may be the casing of an ammunition round, a substantially homogeneous mixture of homogeneous propellant grains and solvent-filled microcapsules in proportion suitable for consolidation under pressure, the solvent-filled microcapsules comprising solvent suitable for solvating the propellant grains; and subjecting the mixture in the forming mold to sufficient pressure to rupture at least a substantial portion of the solvent-filled microcapsules, and thereafter maintaining the mixture in the forming mold for a time sufficient to form a self-supporting formed propellant charge.

The drying mixture and dry forming process of the present invention provides several significant advantages over the prior known methods of fabricating formed propellant charges. The quantity of solvent added to the propellant charge can be precisely controlled and, quite significantly, can be controlled by automatic means. The new procedure provides a cleaner process and, because of the precise control over the quantity of solvent added to the propellant, requires less molding time and less post-molding drying time. Self-supporting formed propellant charges produced according to the present invention can be used in any applications for which such formed propellant charges fabricated according to the old wet solvent method can be used. Thus, for example, the dry solvent/propellant mixture and dry process of the present invention can be used to fabricate the self-supporting formed propellant charge in the form of a hollow tube, as is known for use in telescoped ammunition. Self-supporting formed propellant charges made according to the present invention also are applicable for use in rocket assisted projectiles, other rocket assisted vehicles and like applications. Additional features and advantages of the present invention will be apparent to those skilled in the art in view of the present disclosure.

DETAILED DESCRIPTION OF THE INVENTION

The basic ingredients of the consolidated propellant charge composition of the invention are bulk propellant and solvent-filled microcapsules. The exact formulation of these ingredients will depend upon various factors known to the skilled of the art including, for example, the particular combustion characteristics desired for the propellant such as burn rate. As mentioned above, the consolidated propellant charges of the invention are suitable for use in ammunition rounds and also for other applications calling for a formed propellant, such as rocket assisted projectiles and other rocket assisted vehicles. For purposes of disclosing details of the invention, the present discussion will be in terms of a consolidated propellant charge for a telescoped ammunition round. The formed propellant for a telescoped ammunition round is well known generally to comprise a right cylinder-shaped charge having a centrally located, longitudinally extending bore adapted to receive the ammunition round projectile. The shaped charge may be in one or more than one segment. It will be understood, however, that the principles and details disclosed herein are applicable also for use in the invention in the fabrication of formed propellants for other applications.

The bulk propellant may comprise any of the numerous homogeneous propellant compositions known to the skilled of the art. The propellant must be susceptible to being dissolved by the solvent of the solvent-filled microcapsules. The homogeneous propellant preferably is a nitrocellulose based propellant. While a single base propellant generally is preferred, various multiple base propellants known to the skilled of the art will be recognized in view of the present disclosure as being suitable for use in the invention. One most preferred propellant is a single base (i.e., nitrocellulose based) methylcentralite deterred configuration. As is known in the art, methylcentralite typically is included in the propellant in an amount of about 3% by weight. The propellant is deterred preferably by means of a coating applied to the propellant grains, for example a slurry coating which is applied and then dried on the surface of the propellant. The deterrent is then coated with graphite to complete the process. Although such coating is somewhat disturbed by the action of the solvent reaching and dissolving the surface of the propellant in the consolidation process, sufficient coating remains to provide the deterring function. In addition, it is a significant advantage of the invention that far less of the coating has been found to be disturbed by the use of solvent-filled microcapsules to deliver the solvent to the propellant during the consolidation process then is disturbed by the prior known methods of consolidation involving applying a mist or spray of the solvent to the propellant grains prior to consolidation.

The propellant can be provided in any of numerous known configurations, preferred among which are the extruded propellant grains of generally cylindrical shape having a single axially extending perforation therethrough. Such grains typically have a length and diameter ranging from about 0.05 inch to about 0.17 inch. As is known in the art, the central perforation provides increase surface area and, hence, increased rate of combustion.

Suitable solvent-filled microcapsules are commercially available and will be apparent to the skilled of the art in view of the present disclosure. For the preferred single perforation, single base methylcentralite deterred configuration propellant described above, correspondingly preferred solvent-filled microcapsules are ketone-/alcohol filled microcapsules available under the brand name Micro Ace from Locktite Corporation, Newington,. Connecticut. The ketone may be acetone or other, higher molecular weight ketone and is presently understood to perform the actual solvating of the propellant. The alcohol is understood to act as a carrier for the ketone and preferably consists essentially of ethanol. Preferably the ketone and alcohol are present in a weight ratio of from about 20:80 to about 40:60, respectively. The selection of a suitable solvent will depend upon the chemical formulation of the propellant, including any deterrent coating, etc. and other suitable solvents, many of which are readily commercially available, will be apparent to the skilled of the art in view of the present disclosure.

The microcapsules preferably are in the micron size range, since this enables a substantially uniform distribution of the solvent throughout the propellant grains. This size range provides microcapsules which appear as a dry powder and pour easily. While larger microcapsules can be used, that term being understood herein to include even capsules equal in size to the propellant grains, the smaller microcapsules provide a more uniform distribution of the solvent during the consolidation process and minimize the disturbance of the deterrent coating, if any, on the propellant. This is because the larger microcapsules result in a generally more gross distribution of solvent during the consolidation process, possibly resulting in non-uniform consolidation of the propellant.

The microcapsules can be fabricated of any material compatible with the propellant and which can remain in the self-supporting formed propellant charge without substantial adverse affect on the functioning thereof. The material must be of a type and thickness suitable to be ruptured during the consolidation process. Numerous suitable plastic materials, for example, will be apparent to the skilled of the art in view of the present disclosure. One such suitable material is polyethylene, which is preferred for the ketone/alcohol solvent discussed above.

To fabricate a self-supporting formed propellant charge according to the invention, the solvent-filled microcapsules and the propellant grains are weighed and mixed together in the desired proportions until a substantially homogeneous mixture is achieved. As noted above, the particular propellant and solvent and the particular weight ratio of the two will be selected based on considerations well known to the skilled of the art, including the desired ballistic performance of the consolidated charge. The mixture is poured into a forming mold. The consolidation step is carried out according to methods and techniques well known to the skilled of the art. That is, the consolidation step following admixture of the propellant and microcapsules is carried out in the same manner generally as that currently used for solvent/propellant mixtures in which the solvent has been applied to the propellant as a liquid or by means of a spray, mist or vapor. For purposes of forming a consolidated charge for a telescoped ammunition round, the forming mold typically would include a center mandrel to form the projectile-receiving bore of the consolidated charge. Pressure is then applied to the mixture within the forming mold. Typically, a mold assembly is placed in an hydraulic actuated press. The molding pressure and dwell time are controlled according to known principles and parameters. Specifically, the pressure will vary with the size of the propellant grain and must, in any event, be sufficient to rupture at least a substantial portion of the solvent-filled microcapsules. Preferably, substantially all of the microcapsules are ruptured during the consolidation process. The dwell time should be sufficient to form the propellant grains into a self-supporting formed propellant charge. Typically, approximately three to five minutes is required for this purpose. During the compression, the microcapsules burst and the solvent wets the grain surfaces, at least slightly dissolving them. The propellant grain surfaces, being under pressure, bond together forming the desired consolidated charge. A typical 0.50 caliber telescoped ammunition round would comprise a first consolidated charge being about one inch in diameter and two inches long and a second propellant charge being about one inch in diameter and about one inch long to be loaded in the telescoped round axially behind the first propellant charge. In a typical 20 mm telescoped round, the propellant charge also would comprise two pieces, both one and one-half inches in diameter, the first being about three inches long and the second being about one and one-half inches long. Preferably a double acting press is employed, the finished consolidated charge being pushed out the bottom of the press into a soft-catch receptacle, the central mandrel optionally remaining with the consolidated charge at this stage.

Following consolidation in the press, the self-supporting formed propellant charge preferably is cured in a drying oven. This serves to drive off residual solvent which, as noted above, may comprise both a solvent component and a carrier component. The cured charge typically is quite hard and can be handled without damage for purposes of storage, assembly, etc. Where a self-supporting, formed propellant charge for a telescoped ammunition round is being formed, the center mandrel typically is removed after the curing step. Following curing the consolidated charge may be stored in sealed containers awaiting assembly.

EXAMPLE I

A consolidated charge according to the present invention, that is, a self-supporting formed propellant charge for a 0.50 caliber telescoped ammunition round was prepared in the following manner. A substantially homogeneous mixture was prepared consisting of 19.6 g nitrocellulose propellant, specifically, a single perforation, single base methylcentralite deterred configuration propellant commercially available as Expro 4074-A (trademark) from Expro Chemical Products Inc., P.O. Box 5520, Valleyfield, Quebec, Canada J6S 4V9 and 2.0 g solvent-filled microcapsules. The microcapsules were polyethylene capsules filled with a acetone/ethanol mixture in a weight ratio of 70:30, respectively, commercialy available as Micro Ace (trademark) from Locktite Corporation, Newington, Conn. The mixture in an amount of 21.07 g was loaded into a forming mold in a double acting press with a central mandrel and consolidated under pressure of about 800 psi for a dwell time of five minutes at room temperature (72° F.) and relative humidity of 55%. The overall dimensions of the forming mold cavity were 2.04 inches in length and 0.97 inch in diameter. The consolidated charge was cured in a drying oven to yield a self-supporting formed propellant charge which was sufficiently hard and durable for handling associated with storage and assembly in a telescoped ammunition round. The formed charge was assembled into the forward end of a telescoped ammunition round.

The aft charge for the 0.50 caliber telescoped ammunition round was fabricated as follows. A mixture of 11.2 g of the Expro 4074-A (trademark) propellant and 1.0 g of the Micro Ace (trademark) solvent-filled microcapsules were mixed to a substantially homogeneous mixture, 10.66 g of which was loaded into a forming mold in a double acting press. The molding cavity had an overall length of 1.01 inches and a diameter of 0.962 inches. The propellant/solvent composition was consolidated under about 800 psi for five minutes at room temperature (72° F.) and relative humidity of 55%. The resulting consolidated charge was cured in a drying oven to yield a self-supporting formed propellant charge according to the invention which was sufficiently hard and durable to withstand handling associated with storage and assembly. The charge was assembled into the aft portion of the aforesaid 0.50 caliber telescoped ammunition round. The ammunition round was successfully fired.

While the present invention has been discussed above in connection with certain preferred embodiments, it should be understood that such preferred embodiments are presented by way of illustration and example only and not by way of limitation, the spirit and scope of this invention being limited only by the terms of the appended claims.

We claim:

1. A formable homogeneous propellant composition comprising a mixture of propellant grains and volatile solvent-filled microcapsules in proportion suitable for consolidation under pressure to form a self-supporting formed propellant charge, said solvent-filled microcapsules comprising solvent suitable for solvating said propellant grains.

2. The formable homogeneous propellant composition of claim 1, wherein said propellant grains comprise a single base propellant.

3. The formable homogeneous propellant composition of claim 2, wherein said propellant consists essentially of nitrocellulose.

4. The formable homogeneous propellant composition of claim 3, wherein said propellant grains consist essentially of a single perforation, single base methylcentralite deterred configuration propellant.

5. The formable homogeneous propellant composition of claim 4, wherein said solvent comprises a mixture of ketone and alcohol.

6. The formable homogeneous propellant composition of claim 5, wherein said ketone consists essentially of acetone and said alcohol consists essentially of ethanol.

7. The formable homogeneous propellant composition of claim 6, wherein said acetone and said ethanol are present in a weight ratio of about 20:80 to about 40:60, respectively.

8. The formable homogeneous propellant composition of claim 1, wherein said solvent-filled microcapsules comprise microcapsules fabricated of polyethylene.

9. A process for production of a self-supporting formed propellant-charge, said process comprising:

providing in a forming mold a substantially homogeneous mixture of homogeneous propellant grains and volatile solvent-filled microcapsules in proportions suitable for consolidation under pressure, said solvent-filled microcapsules comprising solvent suitable for solvating said propellant grains; and subjecting said mixture in said forming mold to sufficient pressure to rupture at least a substantial portion of said solvent-filled microcapsules and thereafter maintaining said mixture in said forming mold for a time sufficient to form said self-supporting formed propellant charge.

10. The process for production of a self-supporting formed propellant charge according to claim 9, further comprising curing said propellant charge by exposure thereof to drying heat.

11. The process for production of a self-supporting formed propellant charge according to claim 9, wherein said propellant grains comprise a single base propellant.

12. The process for production of a self-supporting formed propellant charge according to claim 9, wherein said propellant consists essentially of nitrocellulose.

13. The process for production of a self-supporting formed propellant charge according to claim 9, wherein said propellant grains consist essentially of a single perforation, single base methylcentralite deterred configuration propellant.

14. The process for production of a self-supporting formed propellant charge according to claim 9, wherein said solvent comprises a mixture of ketone and alcohol.

15. The process for production of a self-supporting formed propellant charge according to claim 9, wherein said ketone consists essentially of acetone and said alcohol consists essentially of ethanol.

16. The process for production of a self-supporting formed propellant charge according to claim 9, wherein said acetone and said ethanol are present in a weight ratio of about 20:80 to about 40:60, respectively.

17. The process for production of a self-supporting formed propellant charge according to claim 9, wherein said solvent-filled microcapsules comprise microcapsules fabricated of polyethylene.

18. The process for production of a self-supporting formed propellant charge according to claim 9, further comprising removing said propellant charge from said forming mold.

19. The process for production of a self-supporting formed propellant charge according to claim 18, further comprising curing said propellant charge by exposure thereof to drying heat.

* * * * *